US008851905B2

(12) United States Patent
Soubh et al.

(10) Patent No.: US 8,851,905 B2
(45) Date of Patent: Oct. 7, 2014

(54) FIELD-REPLACEABLE PRINTED CIRCUIT BOARD CABLE ASSEMBLY AND METHOD OF USE

(71) Applicants: Emad Soubh, Camas, WA (US); Jason Smith, Sartell, MN (US)

(72) Inventors: Emad Soubh, Camas, WA (US); Jason Smith, Sartell, MN (US)

(73) Assignee: AirBorn, Inc., Georgetown, TX (US)

( * ) Notice: Subject to any disclaimer, the term of this patent is extended or adjusted under 35 U.S.C. 154(b) by 28 days.

(21) Appl. No.: 13/676,050

(22) Filed: Nov. 13, 2012

(65) Prior Publication Data

US 2014/0134888 A1 May 15, 2014

(51) Int. Cl.

| | |
|---|---|
| ***H01R 12/00*** | (2006.01) |
| ***H01R 24/00*** | (2011.01) |
| ***H01R 43/20*** | (2006.01) |

(52) U.S. Cl.

CPC ..... *H01R 24/00* (2013.01); *H01R 43/205* (2013.01); *H01R 43/20* (2013.01)

USPC ..... 439/76.1; 439/499

(58) Field of Classification Search

USPC ..... 439/76.1, 493, 499, 581

See application file for complete search history.

(56) References Cited

U.S. PATENT DOCUMENTS

| | | | | |
|---|---|---|---|---|
| 5,797,771 | A * | 8/1998 | Garside | 439/607.46 |
| 6,155,887 | A | 12/2000 | Cuff et al. | |
| 6,220,869 | B1 | 4/2001 | Grant et al. | |
| 6,318,632 | B1 | 11/2001 | Grant et al. | |
| 6,394,817 | B1 * | 5/2002 | Kihira et al. | 439/76.1 |
| 6,585,528 | B1 * | 7/2003 | Lin et al. | 439/76.1 |
| 6,877,992 | B2 | 4/2005 | Grant et al. | |
| 7,021,942 | B2 | 4/2006 | Grant et al. | |
| 7,187,076 | B2 | 3/2007 | Cuff et al. | |
| D543,508 | S | 5/2007 | Dever | |
| D549,659 | S | 8/2007 | Dever | |
| D560,613 | S | 1/2008 | McEvoy et al. | |
| D560,614 | S | 1/2008 | McEvoy et al. | |
| D561,103 | S | 2/2008 | Grant et al. | |
| D561,107 | S | 2/2008 | Cuff et al. | |
| D561,108 | S | 2/2008 | Cuff et al. | |
| D561,109 | S | 2/2008 | Howerton et al. | |
| D561,110 | S | 2/2008 | Howerton et al. | |
| D561,698 | S | 2/2008 | Cuff et al. | |
| D562,248 | S | 2/2008 | Howerton et al. | |
| D562,249 | S | 2/2008 | Howerton et al. | |
| D562,775 | S | 2/2008 | Cuff et al. | |
| D563,877 | S | 3/2008 | Grant | |
| D563,878 | S | 3/2008 | Grant | |
| D563,879 | S | 3/2008 | Grant | |
| D563,880 | S | 3/2008 | Grant | |
| D563,881 | S | 3/2008 | Howerton et al. | |
| D563,882 | S | 3/2008 | Howerton et al. | |
| D563,883 | S | 3/2008 | Dever | |
| D563,884 | S | 3/2008 | Dever | |

(Continued)

*Primary Examiner* — Gary Paumen

(74) *Attorney, Agent, or Firm* — Locke Lord LLP

(57) ABSTRACT

A field-replaceable printed circuit board ("PCB") cable assembly comprises at least one field-replaceable PCB, at least one cable, a connector with a plurality of beams, and top and bottom hood portions. A first end of the at least one field-replaceable PCB is attached to the at least one cable, and a second end of the at least one field-replaceable PCB is attached to the plurality of beams. The at least one field-replaceable PCB can be replaced by disassembling the hood portions, detaching the at least one field-replaceable PCB from the plurality of beams, and attaching at least one new field-replaceable PCB.

4 Claims, 5 Drawing Sheets

(56) References Cited

U.S. PATENT DOCUMENTS

| | | | | |
|---|---|---|---|---|
| D563,885 | S | 3/2008 | Dever | |
| D563,886 | S | 3/2008 | Dever | |
| D563,887 | S | 3/2008 | Dever | |
| 2003/0119343 | A1* | 6/2003 | Lin et al. | 439/76.1 |
| 2003/0176085 | A1* | 9/2003 | Laker | 439/76.1 |
| 2006/0270271 | A1* | 11/2006 | Moriyama et al. | 439/499 |
| 2009/0197438 | A1* | 8/2009 | Liu et al. | 439/76.1 |

* cited by examiner

FIELD-REPLACEABLE PRINTED CIRCUIT BOARD CABLE ASSEMBLY AND METHOD OF USE

BACKGROUND OF THE INVENTION

1. Field of Invention

The present invention is directed to a field-replaceable printed circuit board ("PCB") cable assembly and method of use.

2. Description of Related Art

Other connectors, such as the Samtec SEARAY, use transition PCBs as a means to attach a cable to a connector. However, these other transition PCBs are not field-replaceable.

SUMMARY

The present invention is directed to a field-replaceable printed circuit board ("PCB") cable connector assembly having one or more field-replaceable PCBs attached to a plurality of electrically conductive beams, such as cantilever beams, which are attached to male (pin) or female (socket) contacts in an electrical connector assembly. The beams straddle the field-replaceable PCBs and are housed in an electrical connector. A first set of fastening members are also partially disposed within the housing portions and are used to secure the present invention to a mating connector. The field-replaceable PCBs and beams are disposed within a top housing portion and a bottom housing portion that are secured by a second set of fastening members.

The straddling of the field-replaceable PCBs by the beams enable the field-replaceable PCBs to be quickly and easily removed and then replaced on-site. A fastening member, such as a screw, can be loosened to separate the housing portions, the field-replaceable PCBs can be detached from the beams, and new field-replaceable PCBs can be installed.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
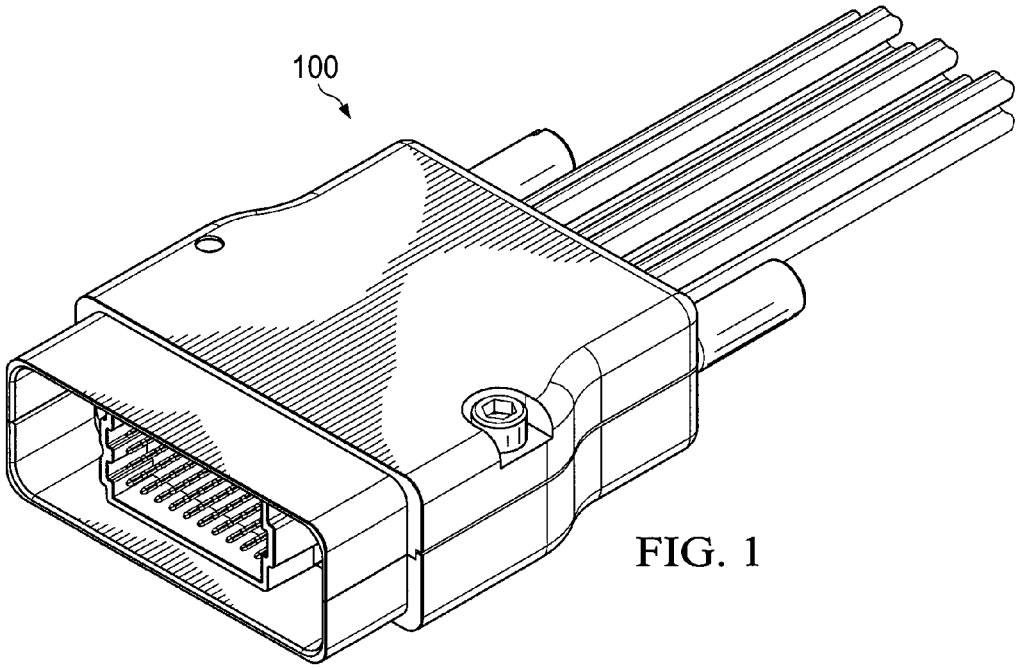
FIG. 1 is a top perspective view of a field-replaceable PCB cable connector assembly.
Figure 2:
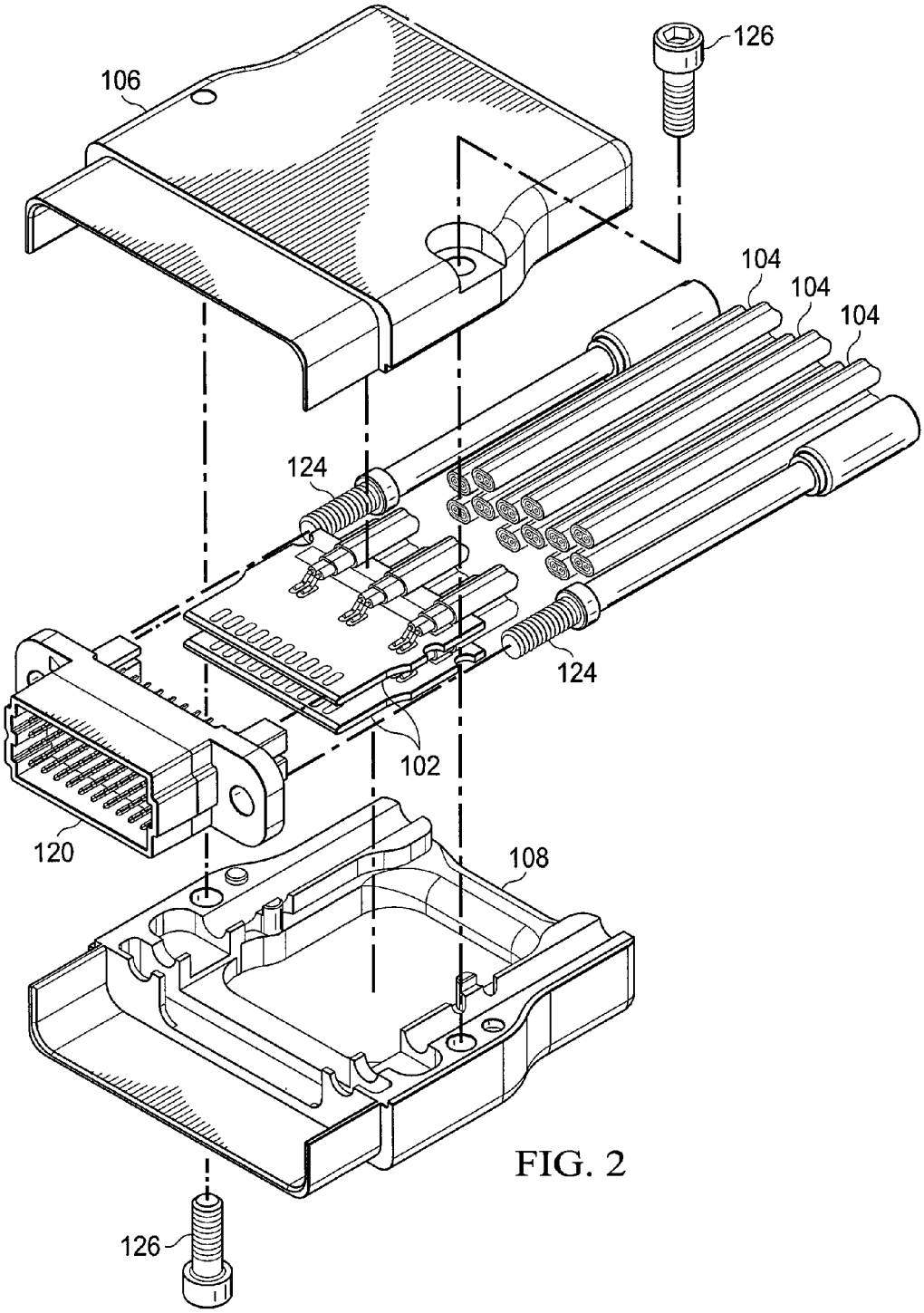
FIG. 2 is an exploded top perspective view of a field-replaceable PCB cable connector assembly.

The present invention is directed to a field replaceable printed circuit board ("PCB") cable assembly 100, as shown in FIGS. 1-7, and its method of use. As shown in FIG. 2, field replaceable PCB cable assembly 100 comprises at least one field replaceable PCB 102, at least one cable 104, a top hood portion 106, a bottom hood portion 108, an electrical connector 120, a first set of fastening members 124, and a second set of fastening members 126. Preferably, top hood portion 106 and bottom hood portion 108 form a protective hood encircling electrical connector 120.

Figure 5:
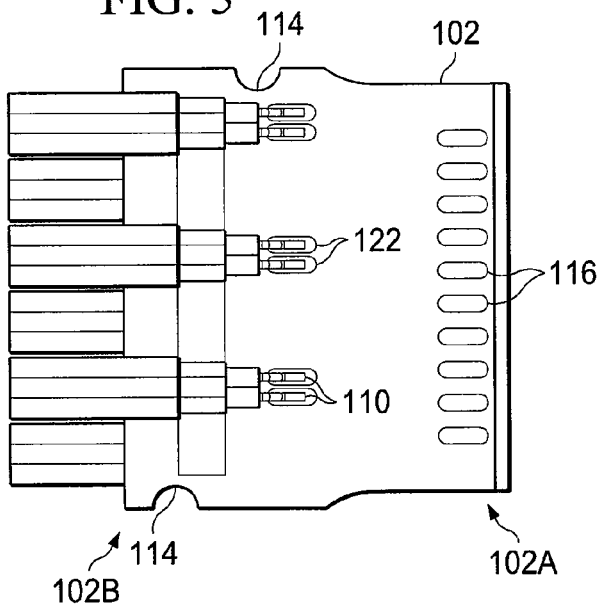
FIG. 5 is a top elevation view of a field-replaceable PCB with cable members attached.
Figure 7:
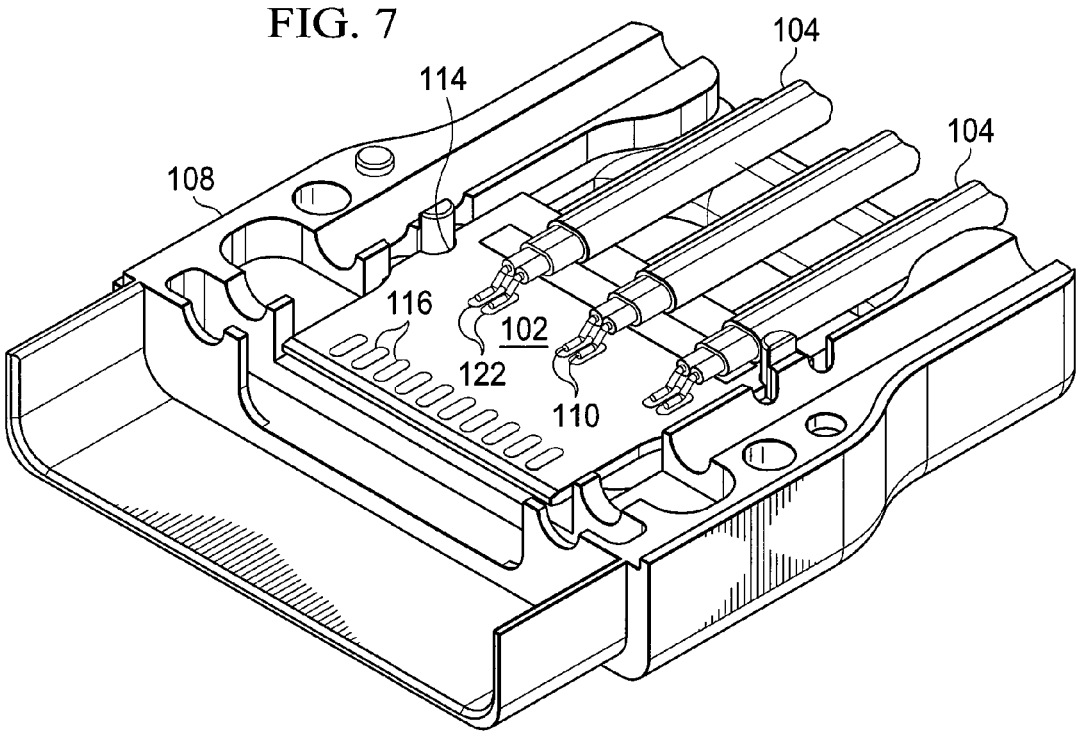
FIG. 7 is a top perspective view of a field-replaceable PCB seated within a bottom hood portion of a housing.

As shown in FIG. 5, at least one field-replaceable PCB 102 features a first end 102A and a second end 102B. A plurality of first conductive pads 116 is placed at or near first end 102A of the at least one field-replaceable PCB 102. A plurality of second conductive pads 122 is placed at or near second end 102B of field-replaceable PCB 102. As shown in FIGS. 5 and 7, the field-replaceable PCB 102 may preferably include a plurality of offset notches 114. As shown in FIG. 7, offset notches 114 can receive various structures or protrusions within the interior surface of bottom hood portion 108. The receiving of these structures by optional offset notches 114 helps to stabilize the at least one field-replaceable PCB 102.

Figure 6:
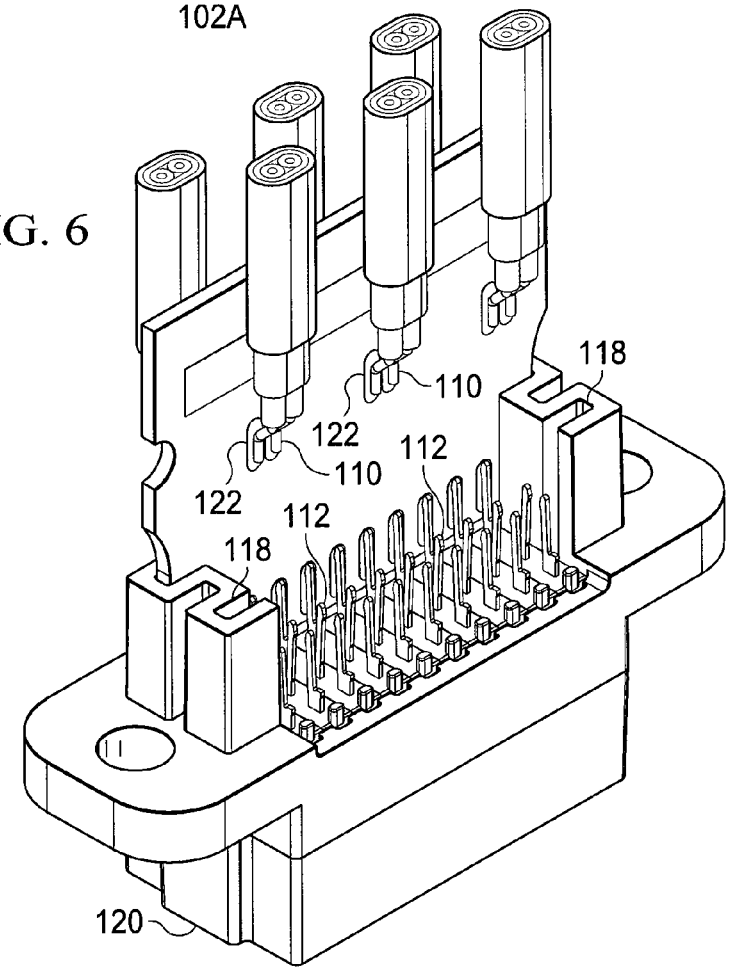
FIG. 6 is a side perspective view of one field-replaceable PCB attached to beams of a connector.

As shown in FIGS. 5-7, wire conductors 110 extend from cable 104 and attach to second conductive pads 122 on the field-replaceable PCB cable assembly 102. First conductive pads 116 are electrically connected to second conductive pads 122 by circuit traces on the PCB. Embodiments of the invention with more than one field-replaceable PCB cable assembly 102 will also have more than one cable 104. Wire conductors 110 are in electrical contact with and can be soldered to second conductive pads 122.

Figure 3:
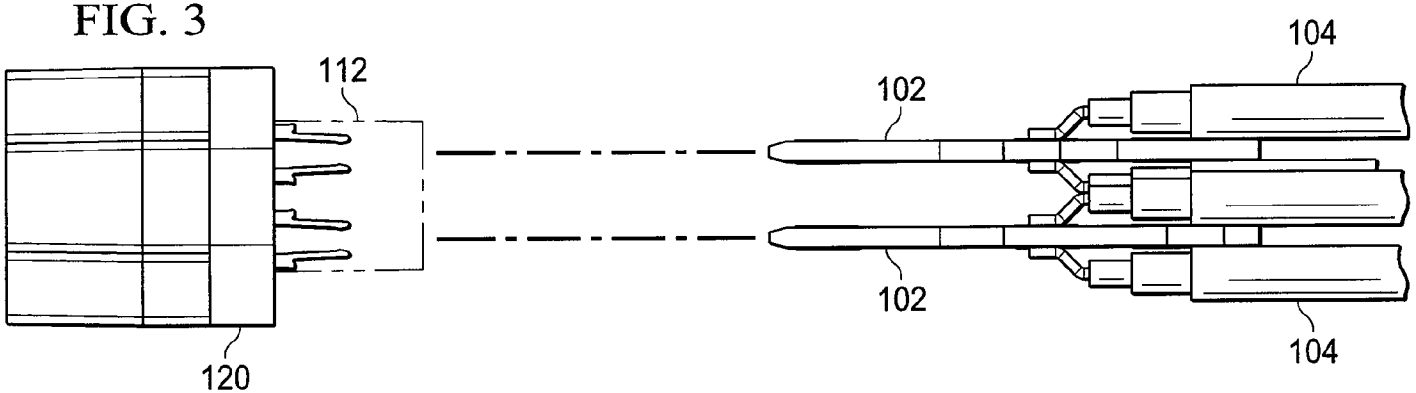
FIG. 3 is a side elevation view of the first ends of field-replaceable PCBs removed from beams of a connector.
Figure 4:
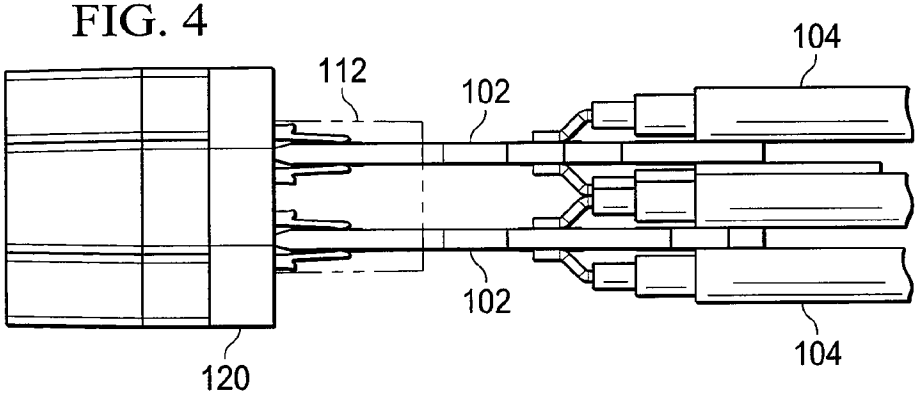
FIG. 4 is a side elevation view of the first ends of field-replaceable PCBs attached to beams of a connector.

As shown in FIGS. 3, 4, and 6, connector 120 comprises a plurality of beams 112. Beams 112 are preferably cantilever beams or some other type of parallel beams. As shown in FIG. 6, connector 120 further comprises a plurality of guide rails 118. In embodiments with more than one field-replaceable PCB 102, connector 120 may preferably include at least one pair of guide rails 118 for each field-replaceable PCB 102. Guide rails 118 help direct and place field-replaceable PCB 102 as beams 112 of connector 120 receive first conductive pads 116 of field replaceable PCB 102. In receiving first conductive pads 116, beams 112 are electrically connected to and detachably straddle field-replaceable PCB 102. Optional guide rails 118 preferably define a channel having a rectangular-shaped cross section to conform to the shape of the edge of the received PCB 102.

As shown in FIGS. 1 and 2, top hood portion 106 and bottom hood portion 108 are secured together by second set of fastening members 126 and house field replaceable PCB 102 and connector 120. Second set of fastening members 126 can be, for example, tightening screws. First set of fastening members 124 are partially housed within top and bottom housing portions 106 and 108 and allow for the securing of field replaceable PCB cable assembly 100 to a mating connector. First set of fastening members 124 can be, for example, thumb screws or jack screws. The longitudinal axis of the first set of fastening members 124 is preferably generally perpendicular to the longitudinal axis of the second set of fastening members 126.

As shown in FIGS. 3, 4, and 6, the parallel contact arrangements of beams 112 enable the field-replaceable PCB 102 to be quickly and easily removed and replaced on-site. The method for removing field-replaceable PCB 102 includes the steps of loosening second set of fastening members 126, separating top hood portion 106 from bottom hood portion 108 and then separating or detaching field-replaceable PCB 102 from beams 112. Such detachment can be accomplished, for example, by simply pulling field-replaceable PCB 102 from beams 112. After field-replaceable PCB 102 is detached, optional steps include providing a new replacement of field-replaceable PCB 102, attaching it to beams 112, connecting top hood portion 106 to bottom hood portion 108, and tightening second set of fastening members 126. Another optional step during the replacement, prior to attachment to beams 112, includes placing field-replaceable PCB 102 within bottom hood portion 108 in such a manner so as to allow offset notches 114 to receive structures or protrusions within the interior surface of bottom hood portion 108. First set of fastening members 124 can be used to secure the connection between field-replaceable PCB cable assembly and a mating connector.

The ability to quickly replace at least one field-replaceable PCB 102 allows for the on-site replacement of either connector 120 or the soldered combination of at least one field-replaceable PCB 102 and at least one cable 104. The replaceability afforded by the invention is useful if connector 120 is damaged, malfunctions, or needs to otherwise be replaced or updated. Moreover, the invention affords the ability to replace only connector 120 and to retain and reuse the remaining components. Similarly, if the soldered combination of field-replaceable PCB 102 and cable 104 is damaged, malfunctions, or needs to otherwise be replaced or updated, connector 120 can be retained and reused while field-replaceable PCB 102 and cable 104 are replaced.

The present invention also provides benefits and advantages from a manufacturing perspective. The present invention eliminates the need to solder each wire conductor 110 from at least one cable 104 to beams 112 of connector 120. At least one field-replaceable PCB 102 provides a user easy access to solder wire conductors 110 to second conductive pads 122. Then, the soldered combination of at least one field-replaceable PCB 102 and at least one cable 104 can be easily and quickly slid into beams 112 of connector 120.

In embodiments not shown in the figures, the present invention can be provided with multiple, and preferably between one and five, field-replaceable PCBs 102 and a corresponding number of cables 104. In this embodiment, beams 112 would be designed to accommodate the number of field replaceable PCBs provided by outfitting connector 120 with the corresponding amount of parallel contacts in the form of beams 112.

Applicants claim:

1. A cable assembly comprising:

at least one cable having wire conductors;

at least one printed circuit board having a first end and a second end, the printed circuit board further having offset notches therein;

a first plurality of pads attached to said first end of said printed circuit board;

a second plurality of pads attached to said second end of said printed circuit board;

a connector having a plurality of beams;

a housing having a top hood portion and a bottom hood portion, the top hood portion having fastener holes therein that align with fastener holes in the bottom hood portion when the housing is assembled; and fastener members configured to be disposed within the fastener holes of the top and bottom portions to fasten the top hood portion to the bottom portion when the housing is assembled, the fastener members also configured to be disposed within the offset notches of the printed circuit board to secure the printed circuit board within the housing when the housing is assembled;

wherein said wire conductors of said cable are attached to said second plurality of pads on said second end of said printed circuit board, and wherein said beams of said connector are separably attachable to said first plurality of pads on said first end of said printed circuit board; and wherein said hood portions are separably attached and can be separated so as to allow for the removal and replacement of said printed circuit board.

2. The cable assembly of claim 1 wherein the cable assembly comprises two printed circuit boards.

3. The cable assembly of claim 1 wherein the beams are cantilever beams.

4. A method of removing and replacing a printed circuit board in a cable assembly having at least one printed circuit board, a connector with a plurality of beams, and a housing having a top hood portion and a bottom hood portion, wherein the at least one printed circuit board is separably attached to said plurality of beams, comprising the steps of:

disengaging fastener members from fastener holes in the top and the bottom portions of the housing and from offset notches in the at least one printed circuit board;

separating said top hood portion from said bottom hood portion;

detaching said at least one printed circuit board from said plurality of beams;

providing at least one new printed circuit board;

attaching said at least one new printed circuit board to said plurality of beams;

attaching said top hood portion to said bottom hood portion; and reengaging the fastener members within the fastener holes in the top and the bottom portions of the housing and within the offset notches in the at least one printed circuit board.

* * * * *